US006218093B1

(12) United States Patent
Thomas

(10) Patent No.: US 6,218,093 B1
(45) Date of Patent: Apr. 17, 2001

(54) PHOTOGRAPHIC SOLUTION FOR DEVELOPING A SILVER HALIDE PHOTOGRAPHIC PRODUCT

(75) Inventor: Francoise M. Thomas, Chalon sur Saone (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/374,913

(22) Filed: Aug. 13, 1999

Related U.S. Application Data

(62) Division of application No. 09/130,036, filed on Aug. 4, 1998, now abandoned.

(30) Foreign Application Priority Data

Aug. 4, 1997 (FR) ..... 97 10170

(51) Int. Cl.[7] ..... G03C 5/305

(52) U.S. Cl. ..... 430/493; 430/403; 430/464; 430/486; 430/487; 430/499

(58) Field of Search ..... 430/464, 486, 430/487, 493, 499, 403

(56) References Cited

U.S. PATENT DOCUMENTS

| | | | | |
|---|---|---|---|---|
| 3,252,798 | * | 5/1966 | Jonker et al. | 430/493 |
| 3,622,330 | * | 11/1971 | Valiaveedan | 430/493 |
| 4,022,621 | * | 5/1977 | Hayashi et al. | 430/493 |
| 4,269,929 | * | 5/1981 | Nothnagle | 430/486 |
| 5,155,014 | * | 10/1992 | De Prijcker et al. | 430/486 |
| 5,215,873 | * | 6/1993 | Kiesslich et al. | 430/493 |
| 5,384,232 | * | 1/1995 | Bishop et al. | 430/487 |
| 5,432,042 | | 7/1995 | Deprez et al. | 430/204 |
| 5,447,817 | * | 9/1995 | Florens et al. | 430/493 |
| 5,474,879 | * | 12/1995 | Fitterman et al. | 430/486 |
| 5,789,144 | * | 8/1998 | Thomas | 430/404 |
| 5,955,246 | * | 9/1999 | Thomas | 430/493 |

FOREIGN PATENT DOCUMENTS

| | | |
|---|---|---|
| 0 628 878 A1 | 12/1994 | (EP) . |
| 63-074056 | 4/1988 | (JP) . |

* cited by examiner

*Primary Examiner*—Hoa Van Le
(74) *Attorney, Agent, or Firm*—J. Lanny Tucker

(57) ABSTRACT

An aqueous solution for developing a silver halide photographic product comprises an alkanolamine in an amount greater than or equal to 0.6 mol/l, at least one wetting agent that is stable at a high pH and miscible in said developing solution, a developing agent capable of reducing the silver ions, and a quaternary ammonium salt having the following formula (I)

wherein $R^1$, $R^2$, $R^3$ and $R^4$ are independently hydrogen, an alkyl group of 1 to 4 carbon atoms, an aromatic carbocyclic group or heterocyclic group that can contain one or more nitrogen atoms, or $R^1$ and $R^2$ together, or $R^1$, $R^2$ and $R^3$ together represent the atoms or bonds necessary for forming a ring with the nitrogen atom, having 5 or 6 atoms in the ring, and X is an anion.

16 Claims, 2 Drawing Sheets

PHOTOGRAPHIC SOLUTION FOR DEVELOPING A SILVER HALIDE PHOTOGRAPHIC PRODUCT

CROSS-REFERENCE TO RELATED APPLICATION

This is a Divisional of application Ser. No. 09/130,036 filed Aug. 4, 1998, now abandoned.

FIELD OF THE INVENTION

The present invention concerns a novel photographic solution for developing a silver halide photographic product, and a method of photographic processing by surface application.

BACKGROUND OF THE INVENTION

Conventionally, processing a black-and-white photographic product comprises a development step, a fixing step and a washing step. The processing of color photographic products comprises a color development step, a bleaching step, a fixing step and a washing step. These processing steps are generally implemented in processing tanks in which the photographic product is immersed.

With methods of processing in tanks, the processing solutions lose their active principles and become loaded with contaminating compounds coming from the photographic product itself or the adjacent processing solutions. The result is a reduction in efficacy of the photographic solutions, that requires the use of replenishing solutions. In particular, the developers that transform the latent image into a silver image by reducing the silver ions become loaded with halide ions coming from the photographic film. The halide ions, in a high concentration in the developing solution, greatly slow down the efficacy of the developer.

The conventional technique of processing in tanks makes it necessary to use large quantities of solution. In addition, the destruction or recycling of these large volumes of solution gives rise to many problems, in particular with respect to environmental protection. These problems are all the greater since the standards for discharging chemical solutions are becoming more and more severe.

In order to limit the problems related to the use of a large volume of solution, it appears advantageous to have a method of developing a photographic product by the surface application of a developing solution.

The technique of development by surface application of a layer of developing solution makes it possible to reduce considerably the volume of processing solution useful for the development, and consequently all the problems of recovery, recycling or destruction. However, the known methods which use this technique present drawbacks. They require for example additional processing steps that are often complex, such as for example the conditioning of the developing solution. In addition, these methods have not made it possible to obtain satisfactory sensitometric results.

SUMMARY OF THE INVENTION

One of the objects of the present invention is to provide an effective developing solution which substantially reduces the volume of solution required for developing a photographic product.

Another object of the invention is to propose a method of developing photographic products that is simple to use, and which avoids the manipulation of large volumes of solution.

The present invention concerns an aqueous developing solution comprising:

- an alkanolamine in an amount greater than or equal to 0.6 mol/l,
- at least one wetting agent that is stable at a high pH and miscible in the developing solution,
- a quaternary ammonium salt, and
- a developing agent capable of reducing the silver ions.

The present invention also concerns a photographic processing kit comprising:

- a developing solution containing a silver ion developing agent, and
- a second solution that contains an alkanolamine in an amount of from 0.6 to 20 mol/l, 0.1 to 20 g/l of a quaternary ammonium salt, 0.1 to 3% by volume of activator of at least one wetting agent that is stable at a high pH and miscible in the developing solution.

The present invention also concerns a method of developing an exposed photographic product that comprises the application of a layer of the developing solution of the invention to the exposed photographic product.

This method makes it possible to develop photographic products rapidly with a very small volume of developing solution. It makes it possible to process in particular high-contrast photographic products, for example photographic products for graphic art.

In addition, such a method avoids the problems of contamination or reduction in efficacy of the developing bath. This is because, in the conventional tank development methods, the same developing bath is used for processing a large number of photographic products. The chemical composition of this bath is modified over time, which gives rise to sensitometric variations in the photographic products being processed. Conventionally, this drawback is eliminated by using replenishing solutions.

In the context of the present invention, the development method eliminates the sensitometric variations due to the use of used baths. This is because the present invention makes it possible to develop photographic products with a developing solution that is never seasoned since this solution, applied in a layer to the photographic product, is used only once. This method eliminates the need to use replenishing solutions.

In addition, the application of the developing solution in a layer greatly reduces the volumes of solution required for the development of the photographic product. In this way the problems of recycling and destruction of photographic effluents are limited, as well as sensitometric variations related to the stirring of the developing baths.

This method reduces the ecological impact of the developing baths by virtue of the low volume of developing solution used. It also reduces the quantities of chemical product used.

DETAILED DESCRIPTION OF THE INVENTION

In the context of the present invention, the method is a method of developing an exposed photographic product by surface application, that is to say the photographic product is not immersed in a tank filled with developing solution, but its face opposite the support is covered with a layer of the developing solution of the present invention. The viscosity of the aqueous developing solution is about the viscosity of water (about 1 cp, 20° C.). The aqueous developing solution does not contain any thickening agent.

According to the invention, it is possible to develop very satisfactorily photographic products exposed with a volume of processing solution of between 20 and 200 ml/m$^2$, and preferably between 20 and 50 ml/m$^2$ of photographic product to be developed. With such a method, it is possible to use a volume of developing solution up to 20 times less than that used with conventional processing methods in tanks.

The application of the developing solution in a layer can be effected by any known means which makes it possible to apply an aqueous solution uniformly to a flat support in order to form a layer. This application can be effected manually or automatically.

Figure 1:
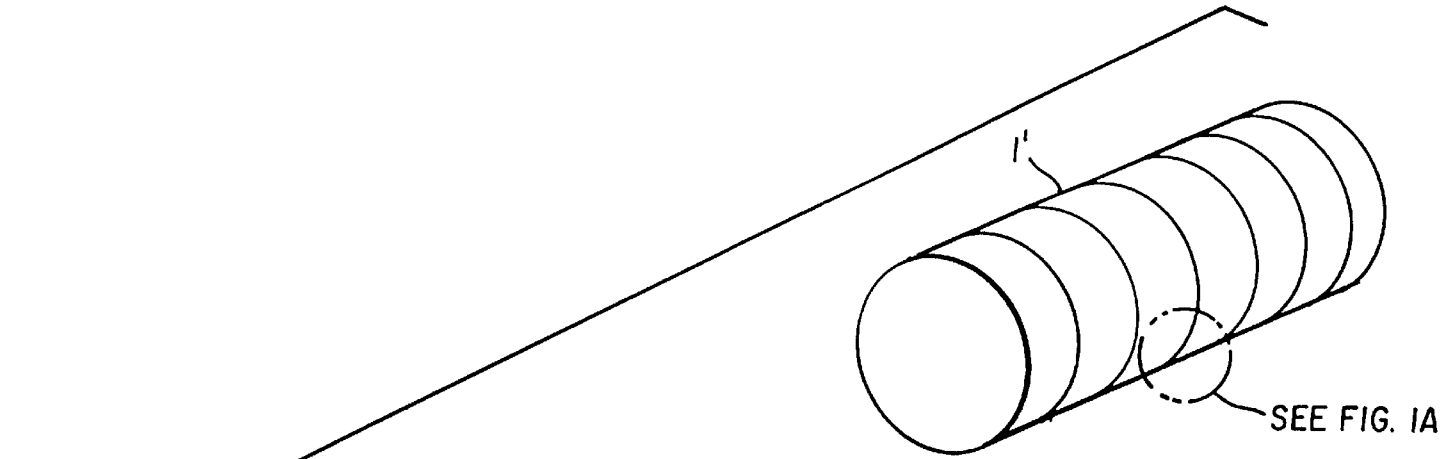
FIG. 1 and FIG. 2 are schematic depictions of devices allowing surface application of the developing solution.
Figure 1A:
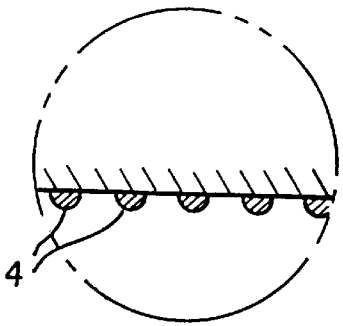

According to one embodiment, the developing solution is applied by means of the device described in FIG. 1, which comprises two rollers 1,1' connected together and forming a reservoir containing the developing solution to be spread 2, the whole being placed on the surface of the film 3 to be developed. The leading roller 1 is covered with a flexible rubber, and the rear roller 1' is a roller with a ribbed surface 4 which controls the spreading of the layer of developing solution. The device is equipped with means for automatically moving the device over the film, which makes it possible to deposit a uniform layer of developing solution on the film (not visible in the figure).

Figure 2:
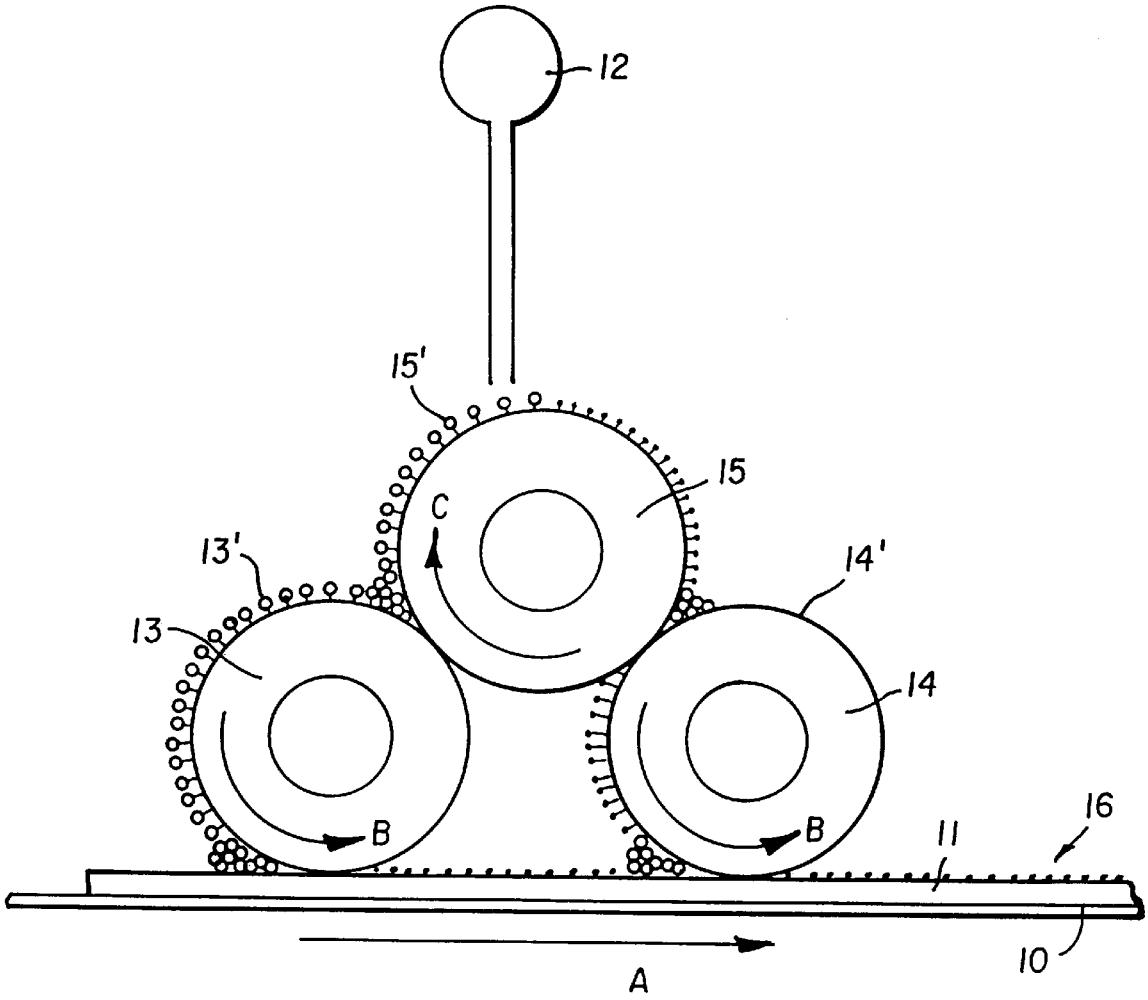

According to another embodiment, the developing solution is applied by means of the device described in the patent application GB 2 306 017 in the name of Kodak Ltd. This device, described in FIG. 2, comprises a surface 10 which supports the photographic product to be developed 11, a means of conveying the photographic product, which does not appear in the figure, a reservoir 12 which delivers a given quantity of developing solution, a means for applying the developing solution which comprises at least two bottom rollers 13, 14 in contact with the photographic product to be developed, and a top roller 15 situated above each of the two bottom rollers 13, 14, the top roller 15 being in contact with the bottom rollers 13, 14. The developing solution is deposited on the surface of the roller 15' and then flows over the surface of the bottom rollers 13', 14'. When the photographic product is moved in the direction of the arrow A, the bottom rollers 13, 14 are rotated as indicated by the arrows B, C, which causes the top roller 15 to rotate. This rotation makes it possible to deposit a layer 16 of developing solution on the film to be developed, as shown in FIG. 2.

The developing agents which can be used are conventional developing agents used alone or in a mixture, soluble in basic medium, for example aminophenols, polyhydroxybenzenes, such as paradihydroxybenzenes, for example hydroquinone or hydroquinone derivatives, 3-pyrazolidinones, pyrogallol, pyrocatechol, ascorbic acid, etc.

In the context of the present invention, the developing agent amount is of at least 0.02 mol/l, preferably between 0.02 mol/l and 1 mol/l, preferably between 0.03 mol/l and 0.6 mol/l.

However, the required amount of developing agent being related to the silver content of the photographic product to be processed, it is possible to envisage the use of a greater amount of developing agent.

According to one embodiment, the developing agent is hydroquinone and/or a hydroquinone derivative, for example methylhydroquinone, hydroquinone monosulfonate, etc. In the remainder of the description, when the term hydroquinone is used, reference is being made to hydroquinone and/or one of its derivatives.

According to another embodiment, the developing agent is ascorbic acid and/or one of its derivatives. The ascorbic acid derivatives are for example L-ascorbic acid, D-isoascorbic acid, D-glucoascorbic acid, 6-desoxy-L-ascorbic acid, ascorbic acid in the form of a salt such as sodium ascorbate, sodium erythorbate, etc. In the remainder of the description, when the term ascorbic acid is used, reference is being made to ascorbic acid and/or one of its derivatives.

According to a different embodiment, the developing solution contains a mixture of hydroquinone (or one of its derivatives) and ascorbic acid (or one of its derivatives). Such a mixture makes it possible to reduce the quantity of hydroquinone necessary for obtaining satisfactory sensitometric results. In this particular embodiment, the molar ratio between hydroquinone and ascorbic acid can vary to a large extent. According to the ratio used, one particular sensitometric characteristic can surprisingly be favored. In particular, when the hydroquinone is in a majority in the mixture, the speed of the film is increased substantially. For ecological reasons, it is preferable to use a mixture in which the ascorbic acid is in a majority. According to a particular embodiment, the hydroquinone/ascorbic acid molar ratio lies between 3 and 0.5, preferably equal to 1.

It is often useful to use, in combination with the main developing agent, a co-developer which, in association with the main developing agent, produces a synergy effect on the development. The quantity of this co-developer is in general very much less than the quantity of main developing agent. The ratio by weight between the developing agent and the co-developer is generally between 3:1 and 500:1, preferably between 50:1 and 250:1.

The co-developers most often used are 3-pyrazolidinone compounds, for example the alkyl-3-pyrazolidinones, the aryl-3-pyrazolidinones, for example 1-aryl-3-pyrazolidinone, 1-phenyl-3-pyrazolidinone (known as phenidone), substituted phenidones, 4-methyl-4-hydroxymethyl phenidone, 1-phenyl-4-methyl pyrazolidinone or 1-phenyl-5-methyl-3-pyrazolidinone. The co-developers most often used are Dimezone S, phenidone and Elon.

When a co-developer is used, it can be introduced into the developing solution and/or into the photographic product to be developed.

When the developing agent is ascorbic acid or one of its derivatives, it is necessary to use a co-developer.

According to one embodiment of the invention, the alkanolamine of the developing composition is a primary, secondary or tertiary amine comprising a linear or branched hydroxyalkyl group comprising 1 to 10 carbon atoms. The alkanolamine can be chosen from amongst monoethanolamine, diethanolamine, 2-alkylethanolamine, 2-methylanolamine, 2-ethylethanolamine, diethyl-N-N-aminoethanol, 3-aminopropanol, 2-amino-1-propanol, 4-amino-1-butanol, 2-amino-1-butanol, 3-diethyl-1-amino-1-propanol, 1-dimethylamino-2-propanol, 2-dimethylaminoethanol, N-ethyldiethanolamine, N-phenyldiethanolamine, triethanolamine, etc. These alkanolamines can be used in a mixture.

According to one embodiment, the alkanolamine concentration is between 0.6 and 2.0 mol/l, preferably between 0.8 and 1.5 mol/l. The developing solution of the invention is a highly basic homogenous aqueous solution. The pH of the developing solution must be greater than 10. The alkanolamine being a buffer substance (around 12), a pH higher than 12 requires the use of large quantities of alkanolamine. When it is desired to use a developing solution with a pH above 13, it is preferably to add a small quantity of strong base (for example KOH) to the developing solution instead of adding a large quantity of alkanolamine. For ecological reasons, it is however preferable to use a developing solution with a pH less than or equal to 13.

According to the present invention, the developing solution comprises at least one wetting agent which makes it possible to obtain a stable homogenous solution. In the context of the present invention, wetting agent refers to a surfactant which facilitates the spreading of the developing solution on the film and which promotes chemical exchanges between the developing solution and the photographic product to be developed. This wetting agent facilitates the penetration and diffusion of the chemical substances of the developing solution towards the silver halide photographic product. It must be photographically inert.

This agent makes it possible to obtain a uniform layer of developing solution on the photographic product to be developed. It must be miscible in the developing solution, that is to say it must form a homogenous solution with the other compounds present in the developing solution. It must be stable over time in a highly basic medium. This is because the developing solution must be able to be stored without losing its development or spreading properties. By way of example, these wetting agents can be anionic, cationic, non-ionic or amphoteric surfactants, alone or in a mixture. These surfactants are for example Zonyl FSN® or Alkanol XCR® manufactured by DuPont, Lodyne S-100® manufactured by Ciba-Geigy or Olin 10G® manufactured by Olin Mathieson.

It is very important within the context of the present invention to obtain a layer of developing solution which is uniform over the entire surface of the film to be processed. Parts of film not covered by this layer must not appear after application of the developing solution.

According to the method of the present invention, the developing solution contains quaternary ammonium salts. These quaternary salts are illustrated by the following formula:

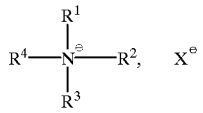

(I)

in which $R^1$, $R^2$, $R^3$ and $R^4$ are independently chosen from amongst hydrogen, an alkyl group with 1 to 4 carbon atoms, an aromatic group which may contain one or more nitrogen atoms or the groups $R^1$ and $R^2$ together, or $R^1$, $R^2$ and $R^3$ together can also represent the atoms or bonds necessary for forming a ring, with the nitrogen atom, aromatic or otherwise, with 5 to 6 members.

X is the anion which balances the charge of the molecule. X can for example be a halide or a sulfonate.

According to the invention, the quantity of quaternary ammonium salts is between 0.1 and 20 g/l, preferably between 1 and 10 g/l.

These quaternary ammonium salts can be for example 1-phenethyl-2-methyl pyridinium bromide, 2-phenethyl-1-pyridinium bromide, 1-phenethyl-2-pyridinium bromide, 2,6-dichlorobenzyl-1-pyridinium bromide, benzyltriethyl ammonium chloride, tetrabutylammonium perchlorate, 1,4-dimethylpyridinium p-toluene sulphonate, 1-methyl-2-propynyl-2-pyrydinium bromide, or tetrapropyl ammonium chloride.

According to a preferred embodiment, the quaternary ammonium salt is a salt of formula (I) in which at least one of the groups $R^1$, $R^2$ and $R^3$ together is an aryl group. According to another preferred embodiment, the quaternary ammonium salt is a salt of formula (I) in which $R^1$, $R^2$ and $R^3$ together represent the atoms necessary for forming a pyridinium heterocyclic compound. According to one embodiment of the invention, the ammonium salt is 1-phenethyl-2-methyl pyridinium. In the scope of the present invention, the wetting agent differs from the quaternary ammonium salt.

According to a particular embodiment of the present invention, the developing solution is in the form of a kit comprising two solutions, a first solution containing the developing agent or agents in aqueous solution, the pH of this solution make it possible to keep the effective quantity of developing agent dissolved, a second solution containing the other components of the developing solution. The ready-to-use developing solution of the invention is obtained by mixing the two solutions described previously. It may then be necessary to effect an adjustment of the pH.

According to one embodiment, the developing solution comprises an alkanolamine in a quantity greater than or equal to 0.6 mol/l; 0.1 to 20 g/l of a quaternary ammonium salt; 0.1 to 3% by volume of developing solution of, at least one wetting agent which is stable at a high pH and which is miscible in the developing solution, and at least 0.02 mol/l of developing agent.

The developing solution of the present invention may contain other compounds such as for example anti-fogging agents, preservatives, bacteriocides, fungicides, sequestering agents or buffer compounds. Examples of these compounds are described in *Research Disclosure*, September 1994, 365, N° 36544 (hereinafter referred to as *Research Disclosure*), Section XIX. When nucleated-chemistry photographic products are developed, it is particularly advantageous to use a developing solution which contains 5-nitroindazole as an anti-fogging agent.

In the context of the present invention, any type of silver halide photographic product can be processed with the developing solution of the present invention. It is for example possible to process positive-working or negative-working photographic products, black-and-white photographic products, reversal photographic products, etc.

In particular, very good sensitometric results have been obtained with conventional films for graphic arts and nucleated films for graphic arts. Nucleated films are films which contain a nucleating agent and a booster. The nucleating agents are generally hydrazines, boosters of amino compounds. Such films are known in the field of photography. They were described for example in U.S. Pat. No. 4,975,354 and U.S. Pat. No. 5,213,944.

The photographic products which can be developed with the solution of the present invention can contain any type of photographic emulsion. For example, these examples can comprise three-dimensional, cubic, tabular, silver halide grains.

According to a preferred embodiment, the photographic product which is processed with the solution of the present invention contains silver halide emulsions containing at 50% mol chloride based on silver, whilst the remaining halides can be bromide, iodide or a mixture.

In the context of the present invention, the emulsions can be pure chloride, chlorobromide, chlorobromoiodide, chloroiodobromide and chloroiodide emulsions. When reference is made to silver halide grains or silver halide emulsions containing at least two silver halides, the halides are cited in decreasing order of concentration.

Although the silver halide grains can be saturated with iodide (around 40% mol), it is preferable to limit the iodide to less than 20% mol, preferably less than 10% mol, based on silver. Very small quantities of iodide are generally sufficient to increase the sensitivity of the emulsion.

The present invention is described in more detail in the following examples.

EXAMPLE 1

The photographic product used in this example comprises an ESTAR® ethylene polyterephthalate support coated with a layer of silver halide emulsion containing the emulsion described below, a hydrazine nucleating agent of formula (I) (0.0046 g/m$^2$), and an hardening agent (bisvinylmethylsulfone, 3.5% by weight based on the total dry gelatin).

The layer of silver halide emulsion is covered with an intermediate layer of gelatin (0.65 g/m$^2$) containing an incorporated development booster of formula (II) (0.052 g/m$^2$).

The intermediate layer is covered with a protective top layer of gelatin (1 g/m$^2$).

The silver halide emulsion is a cubic grain emulsion (edges 0.18 $\mu$m) of silver chlorobromide (70 mol % chloride). The emulsion is chemically sensitized. It is red chromatized with a spectral sensitizer having a maximum absorption around 630 nm.

The silver content of the layer of emulsion is 2.8 g/m$^2$. The gelatin content is 1.8 g/m$^2$.

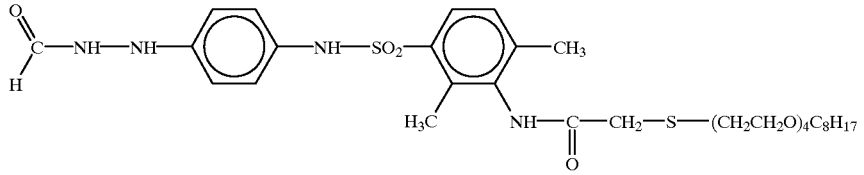

(I)

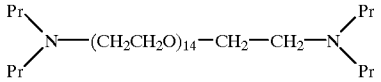

(II)

Pr being n-propyl.

The photographic product described above is exposed through a sensitometric wedge with 18 levels (increments of 0.1) with a xenon flash exposure meter for two microseconds through a Wratten 29 filter.

The exposed film is developed by applying to this film a layer of developing solution having the following composition at room temperature in a quantity of around 20 ml/m$^2$:

Composition of the developing solution

| | Concentration |
|---|---|
| 2-methyl-amino ethanol | 70 g/l (0.9 mol/l) pH = 12 |
| 5-nitroindazole | 0.2 g/l |
| KBr | 5 g/l |
| $K_2SO_3$ | 99 g/l |
| PEPB* | 2 g/l |
| OLIN 10G ® wetting agent | 30 cc/l |
| Developing agent | See Tables 1a, 1b, 1c |
| Co-developer | See Tables 1a, 1b, 1c |

*PEPB: 1-phenethyl-2-methylpyridinium bromide

The developing solution is applied by means of the device described in FIG. 1.

In this way a layer of developing solution is formed which makes it possible to develop the film.

The device is then moved in the opposite direction in order to eliminate the excess developing solution. In this embodiment, the developing solution remains in contact with the film for 20 seconds.

The film is then placed in a stop bath (30 seconds), a fixing bath (1 min at 25° C.), followed by a washing bath.

By reading with a densitometer, a sensitometric curve is obtained from which the following sensitometric parameters are determined:

Dmin (density of the support+fog)

Dmax (point of maximum density)

Effective contrast (EC) (slope of the sensitometric curve measured between a density of 0.1 and 2.5)

Toe contrast (TC) of the sensitometric curve (slope of the sensitometric curve measured between a density of 0.1 and 0.6).

Speed (S) (sensitivity of the film measured at a density of 2 above the Dmin)

The sensitometric results are set out in the following Tables 1.

TABLE 1

| | Ex. 1.1<br>30 g/l HQ<br>1,5 g/l HMMP | Ex. 1.2<br>45 g/l HQ<br>— | Ex. 1.3<br>45 g/l HQ<br>0,75 g/l HMMP |
|---|---|---|---|
| Dmin | 0.03 | 0.03 | 0.,1 |
| Dmax | 5.2 | 3.9 | 5.1 |
| R | 372 | 334 | 372 |
| TC | 8.7 | 6.1 | 6.2 |
| CE | 14.3 | 10.3 | 12.3 |

TABLE 1-continued

| | Ex. 1.4 48 g/l AA 1,5 g/l HMMP | Ex. 1.5 72 g/l AA 1,5 g/l HMMP | Ex. 1.6 96 g/l AA 1,5 g/l HMMP |
|---|---|---|---|
| Dmin | 0.02 | 0.03 | 0.03 |
| Dmax | 3.6 | 4.6 | 4.8 |
| R | 348 | 352 | 353 |
| TC | 5.3 | 5.6 | 5.5 |
| CE | 11.2 | 12.4 | 13 |

| | Ex. 1.7 24 g/l AA + 15 g/l HQ 1,5 g/l HMMP | Ex 1.8 36 g/l AA + 22,5 g/l HQ 1,5 g/l HMMP | Ex. 1.9 48 g/l AA + 30 g/l HQ 1,5 g/l HMMP |
|---|---|---|---|
| Dmin | 0.02 | 0.02 | 0.03 |
| Dmax | 4.8 | 5.4 | 5.5 |
| R | 353 | 356 | 360 |
| TC | 6.5 | 7.2 | 6.3 |
| CE | 13.4 | 15.5 | 15.2 |

HQ: Hydroquinone (main developing agent)
HMMP: 4-hydroxymethyl-4-methyl-1-phenyl-3-pyrazolidinone (co-developer)
AA: Ascorbic acid (main developing agent)

These results show that the sensitometric properties obtained by developing a conventional nucleated-chemistry photographic film by the surface application of the developing solution of the present invention are entirely satisfactory.

EXAMPLE 2

The photographic product used in this example comprises an ESTAR® ethylene polyterephthalate support covered with a gelatin underlayer (1.8 g/m$^2$) containing the hydrazine nucleating agent of formula (I) (0.006 g/m$^2$), the incorporated amino booster of formula (II) (0.05 g/m$^2$), a latex (0.4 g/m$^2$) and a bisvinylmethylsulfone agent (3.5% by weight based on the total dry gelatin).

The underlayer is covered with a layer of silver halide emulsion, itself covered with a protective top layer of gelatin (0.8 g/m$^2$).

The silver halide emulsion is a cubic grain emulsion (edge 0.1 $\mu$m) of silver chlorobromide (70 mol % chloride) (silver content: 1.8 g/m$^2$, gelatin content: 1.3 g/m$^2$).

The film is exposed and developed as described in Example 1 with a developing solution having the following composition:

| Composition of the developing solution | Concentration |
|---|---|
| 2-methyl-amino ethanol | 70 g/l (0.9 mol/l) pH = 12 |
| 5-nitroindazole | 0.2 g/l |
| KBr | 5 g/l |
| $K_2SO_3$ | 99 g/l |
| PEPB* | 2 g/l |
| OLIN 10G ® wetting agent | 30 cc/l |
| Developing agent | See Tables 2a, b |
| Co-developer | See Tables 2a, b |

TABLE 2

| | Ex. 2.1 | Ex. 2.2 45 g/l | Ex. 2.3 15 g/l HQ | Ex. 2.4 15 g/l HQ |
|---|---|---|---|---|
| | 30 g/l HQ | HQ | 0.25 g/l HMMP | 0.75 g/l HMMP |
| Dmin | 0.02 | 0.02 | 0.04 | 0.02 |
| Dmax | 3.6 | 4.1 | 3.8 | 3.8 |
| S | 330 | 366 | 368 | 368 |
| TC | 4.0 | 3.6 | 6.0 | 4.1 |
| EC | 7.3 | 7.5 | 9.00 | 7.1 |

| | Ex. 2.5 48 g/l AA 1.5 g/l HMMP | Ex. 2.6 72 g/l AA 1.5 g/l HMMP | Ex. 2.7 96 g/l AA 1.5 g/l HMMP |
|---|---|---|---|
| Dmin | 0.03 | 0.05 | 0.07 |
| Dmax | 3.6 | 4.0 | 4.1 |
| S | 365 | 367 | 370 |
| TC | 5.3 | 6.03 | 7.3 |
| EC | 9.9 | 11.3 | 11.5 |

These results show that highly satisfactory results are obtained by the surface application of the solution of the present invention. In particular, an effective contrast greater than 5 is obtained, which is compatible with use for graphic arts. Surprisingly, these results are better with a developing solution containing ascorbic acid.

EXAMPLE 3

The photographic product used in this example comprises an ESTAR® ethylene polyterephthalate support covered with a layer of silver halide emulsion containing the emulsion described below and bisvinylmethylsulfone tanning agent (3.5% by weight based on total dry gelatin).

The layer of silver halide emulsion is covered with an intermediate layer of gelatin (0.65 g/m$^2$), itself covered with a protective top layer of gelatin (0.5 g/m$^2$).

The silver halide emulsion comprises cubic grains (0.2 $\mu$m edge) of silver chlorobromide (70 mol % chloride). The grains are chemically sensitized. They are red chromatized with a spectral sensitizer having a maximum absorption of 630 mm.

The silver content of the layer of emulsion is 4.0 g/m$^2$ and the gelatin content is 2.6 g/m$^2$.

The photographic product is then exposed and developed according to the method of Example 1 with a developing solution having the following composition:

| | Concentration |
|---|---|
| 2-methyl-amino ethanol | 70 g/l (0.9 mol/l) pH = 12 |
| 5-nitroindazole | 0.3 g/l |
| KBr | 5 g/l |
| $K_2SO_3$ | 99 g/l |
| PEPB* | 5 g/l |
| OLIN 10G ® wetting agent | 30 cc/l |
| Developing agent | See Table 3 |
| Co-developer | See Table 3 |

The photographic product is then fixed and rinsed conventionally according to the Kodak® RA2000® process.

The sensitometric results are set out in Table 3 below.

TABLE 3

| | Ex. 3.1<br>45 g/l HQ<br>0.75 g/l HMMP | Ex. 3.2<br>72 g/l AA<br>0.75 g/l HMMP | Ex. 3.3<br>22.5 g/l HQ + 36 g/l AA<br>0.75 g/l HMMP |
|---|---|---|---|
| Dmin | 0.02 | 0.025 | 0.03 |
| Dmax | 5.7 | 5.1 | 5.6 |
| S | 386 | 384 | 385 |
| TC | 3.7 | 3.6 | 3.8 |
| EC | 8.0 | 7.8 | 8.2 |

These results show that, with a conventional photographic product through the surface application of the solution of the present invention, satisfactory sensitometric results are obtained. As before, an effective contrast greater than 5 is obtained which is perfectly compatible with use for graphic arts. It is noted that, with a developing solution containing hydroquinone and ascorbic acid, the toe contrast is increased.

EXAMPLE 4

In this example, a photographic product as described in Example 2 is used, but in which a Co-developer (HMMP: 0.1 g/m$^2$) is incorporated in the underlayer.

This product is developed and processed as previously described with a developing solution which does not contain any co-developer, having the following composition:

| | Concentration |
|---|---|
| 2-methyl-amino ethanol | 70 g/l (0.9 mol/l) pH = 12 |
| 5-nitroindazole | 0.2 g/l |
| KBr | 5 g/l |
| $K_2SO_3$ | 99 g/l |
| PEPB* | 2 g/l |
| OLIN 10G ® wetting agent | 30 cc/l |
| Developing agent | See Table 4 |

The sensitometric results are set out in Table 4 below.

TABLE 4

| | Ex. 4.1<br>72 g/l AA | EX. 4.2<br>24 g/l AA + 15 g/l HQ |
|---|---|---|
| Dmin | 0.03 | 0.04 |
| Dmax | 4.1 | 4.0 |
| S | 371 | 380 |
| TC | 6.2 | 5.3 |
| EC | 12.0 | 12.7 |

These results show that satisfactory sensitometric results are obtained with a developing solution which does not contain a co-developer, the co-developer being incorporated in the photographic product.

EXAMPLE 5

The product used in this example is a photographic product of Example 1.

This film is exposed and developed as in Example 1, that is to say by applying, in a thin layer, a conventional developing solution for developing a nucleated-chemistry film (concentrated Kodak RA2000® process), where the pH has been adjusted to 12 by adding KOH, the solution containing:

| Compounds | Concentration |
|---|---|
| Sodium metabisulfite | 72.3 g/l |
| NaBr | 11.4 g/l |
| Complexing agents | 39.75 g/l |
| NaOH | 19.05 g/l |
| Anti-fog agents | 0.67 g/l |
| Diethylene glycol | 110 g/l |
| Hydroquinone | 75 g/l |
| HMMP | 2.4 g/l |
| Anti-oxidant | 105 g/l |
| Buffer agent | 54.4 g/l |
| pH | 12 |

The sensitometric results are set out below.

TABLE 5

| | Ex. 5.1 (comparative)<br>RA2000 ® | Ex. 5.2 (invention)<br>45 g/l HQ<br>0.75 g/l HMMP |
|---|---|---|
| Dmin | 0.05 | 0.06 |
| Dmax | 1.6 | 5.1 |
| S | —◆ | 373 |
| TC | 3.9 | 6.2 |
| EC | 0.0 | 12.3 |

◆not calculated

These results show that the sensitometric results obtained by the surface application of a conventional developing solution are mediocre. In particular, a maximum density well below 2 is obtained, an effective contrast below 5. Example 5.2 illustrating the present invention shows that, under the same development conditions, the developing solution of the present invention gives satisfactory sensitometric results with reduced quantities of developing agent and Co-developer.

EXAMPLE 6

The product used in this example is the photographic product of Example 3.

In Example 6.1, the film is developed in a conventional fashion in a tank with the Kodak RA2000® (1+2) developing solution described in Example 5.

In Examples 6.2 and 6.3, the film is developed by the application of a layer of developing solution of the invention identical to that of Example 3.

The sensitometric results obtained are set out in Table 6 below.

TABLE 6

| | Ex. 6.1<br>RA2000-Tank | Ex. 6.2<br>36 g/l AA + 22.5 g/l HQ<br>0.75 g/l HMMP | Ex. 6.3<br>45 g/l HQ<br>1.5 g/l HMMP |
|---|---|---|---|
| Dmin | 0.02 | 0.03 | 0.02 |
| Dmax | 5.6 | 5.6 | 5.8 |
| S | 375 | 385 | 387 |
| TC | 2.5 | 3.8 | 3.8 |
| EC | 5.6 | 8.2 | 8.5 |

These results show the advantages of the present invention.

The invention has been described in detail with particular reference to certain preferred embodiments thereof, but it will be understood that variations and modifications can be effected within the spirit and scope of the invention.

I claim:

1. A photographic processing kit comprising:

a first solution containing a silver ion developing agent, and a second solution that contains an alkanolamine in an amount of from 0.6 to 20 mol/l, 0.1 to 20 g/l of a quaternary ammonium salt, 0.1 to 3% by volume of at least one wetting agent that is stable at a high pH.

2. A method for developing an exposed silver halide photographic product comprising a support having thereon a silver halide emulsion layer which comprises applying to the surface of the product opposed to the support, a layer of an aqueous developing solution comprising:

an alkanolamine in an amount greater than or equal to 0.6 mol/l, 0.1 to 3% by volume of the developing solution of at least one wetting agent having a high pH stability, miscible in said developing solution, and promoting the formation of the layer, at least 0.02 mol/l of a developing agent capable of reducing the silver ions, and 0.1 to 20 g/l of a quaternary ammonium salt having the following formula (I)

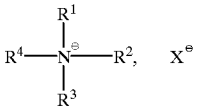

wherein $R^1$, $R^2$, $R^3$ and $R^4$ are independently hydrogen, an alkyl group of 1 to 4 carbon atoms, an aromatic carbocyclic group or heterocyclic group that can contain one or more nitrogen atoms, or $R^1$ and $R^2$ together, or $R^1$, $R^2$ and $R^3$ together represent the atoms or bonds necessary for forming a ring with the nitrogen atom, having 5 or 6 atoms in the ring, and X is an anion.

3. The method of claim 2 wherein said developing solution is applied to said photographic product in an amount of from 20 ml/m$^2$ to 200 ml/m$^2$.

4. The method of claim 2 wherein said photographic product comprises a silver halide emulsion containing at least 50% molar chloride based on the silver content.

5. The method of claim 2 wherein said photographic product is a nucleated-chemistry product.

6. The method of claim 2 wherein said photographic product contains a co-developer and said developing solution is free of co-developer.

7. The method of claim 2 further comprising a co-developer.

8. The method of claim 7 wherein said co-developer is a 1-aryl-3-pyrazolidinone compound.

9. The method of claim 2 wherein said quaternary ammonium salt is present in an amount of from 1 to 10 g/l.

10. The method of claim 2 wherein $R^1$, $R^2$ and $R^3$ together represent the atoms necessary for forming with the nitrogen atom, a pyridinium ring, thereby forming a pyridinium salt.

11. The method of claim 10 wherein said pyridinium salt is the salt of 1-phenethyl-2-methyl-pyridinium.

12. The method of claim 2 wherein said alkanolamine is monoethanolamine, diethanolamine or 2-alkyl-ethanolamine.

13. The method of claim 12 wherein said alkanolamine is 2-methyl-aminoethanol.

14. The method of claim 2 wherein said developing agent is hydroquinone, a hydroquinone derivative, ascorbic acid or a derivative of ascorbic acid, or a mixture of any of these.

15. The method of claim 14 wherein said developing agent is ascorbic acid or one of its derivatives, and said solution further contains 1-aryl-3-pyrazolidinone as a co-developer in a quantity such that the ratio by weight of ascorbic acid to co-developer is between 3:1 and 500:1.

16. The method of claim 2 further containing a 5-nitroindazole anti-fogging compound.

* * * * *